US006270435B1

(12) United States Patent
Sodaro

(10) Patent No.: US 6,270,435 B1
(45) Date of Patent: Aug. 7, 2001

(54) ARROWHEAD

(75) Inventor: John C. Sodaro, Monkton, VT (US)

(73) Assignee: Arvid Ames, Tomahawk, WI (US); a part interest ( * ) Notice: Subject to any disclaimer, the term of this patent is extended or adjusted under 35 U.S.C. 154(b) by 0 days.

(21) Appl. No.: 09/617,412

(22) Filed: Jul. 17, 2000

(51) Int. Cl.[7] ..... F42B 6/08
(52) U.S. Cl. ..... 473/583
(58) Field of Search ..... 473/583, 584, 473/FOR 221, FOR 222

(56) References Cited

U.S. PATENT DOCUMENTS

| | | | | |
|---|---|---|---|---|
| 1,222,142 | * | 4/1917 | Rossi | 473/583 X |
| 1,318,858 | * | 10/1919 | Frick | 473/583 X |
| 2,859,970 | * | 11/1958 | Doonan | 473/583 |
| 3,036,395 | * | 5/1962 | Nelson | 473/583 X |
| 3,738,657 | | 6/1973 | Cox . | |
| 3,910,579 | | 10/1975 | Sprandel . | |
| 3,915,455 | | 10/1975 | Savora . | |
| 4,099,720 | | 7/1978 | Zeren . | |
| 4,558,868 | | 12/1985 | Musacchi . | |
| 4,579,348 | | 4/1986 | Jones . | |
| 4,973,060 | | 11/1990 | Herzing . | |
| 5,033,220 | | 7/1991 | Phelps . | |
| 5,066,021 | | 11/1991 | DeLucia . | |
| 5,078,407 | | 1/1992 | Carlston et al. . | |
| 5,100,143 | | 3/1992 | Puckett . | |
| 5,172,916 | | 12/1992 | Puckett . | |
| 5,458,341 | | 10/1995 | Forrest et al. . | |
| 5,564,713 | | 10/1996 | Mizek et al. . | |
| 5,820,498 | | 10/1998 | Maleki . | |
| 5,879,252 | | 3/1999 | Johnson . | |
| 5,941,784 | | 8/1999 | Mizek . | |
| 6,015,357 | | 1/2000 | Rizza . | |

* cited by examiner

*Primary Examiner*—John A. Ricci
(74) *Attorney, Agent, or Firm*—Mathew R. P. Perrone, Jr.

(57) ABSTRACT

An arrowhead has spring loaded blades restrained thereon, which blades release and penetrate a target as the target is struck by the arrow. This arrowhead provides the striking power of an arrowhead known as a broadhead, while having streamlined flight characteristics.

16 Claims, 2 Drawing Sheets

ARROWHEAD

This invention relates to an arrowhead and more particularly to a broadhead arrowhead suitable for hunting big game.

BACKGROUND OF THE INVENTION

As a weapon, a bow and arrow can be extremely effective. It is known to be used for hunting; whether the target is an animal for food, or another human being for conflict. The firearm is a replacement for the bow and arrow. However, a bow and arrow are still used, more for hunting than human conflict.

While the bow is the propelling device, the arrow is the launched missile. The arrow has a shaft and a head. The arrowhead is designed to penetrate the target. The shaft is designed to hold the arrowhead at one end thereof; while the other end fits on the bowstring, and has feathers or guidance devices mounted adjacent thereto.

In hunting, it is desired that an arrowhead inflict a fatal wound on an animal. This requires a great deal of skill on the archer's part and a great deal of good fortune. If the arrowhead does not hit the game at just the right point, a fatal wound will not result, and the hunter will not have meat. The arrow can be deflected from a fatal wound by bone or other parts of the animal. The animal may then escape the hunter's view, and the desired effect of recovering the animal for food cannot be accomplished.

There are arrowheads designed to ensure the chance of providing a quick fatal wound to the animal. With this quick and fatal wound, very little animal suffering will occur, and the meat will be obtained. There are various types of modifications to achieve this desired result.

One standard hunting arrowhead is a broadhead. Such an arrowhead has great penetrating power. However, the structure is not streamlined, which interferes with the arrow flight. If the penetrating power of broadhead can be obtained, with maintained, desirable flight characteristics, great advantages can be obtained.

Such modifications have an adverse effect on the true flight of the arrow. The head and the shaft of the arrow are required to have a shape, which does not interfere with the arrow in flight. Thus, the additions to the head or the shaft must not interfere with the arrow flight.

It is also difficult to fit the arrowhead onto the appropriate shaft. If the arrow does not fit properly on the appropriate shaft, the desired results cannot be obtained. Thus, it is desired to have the arrowhead fit on the arrow at the appropriate position, it is also desired to have the arrow be effective.

One prior art device for overcoming these problems involves putting additional blades on the arrowhead. The additional blades secured to the arrows or arrowheads of the prior art, interfere with the streamlined effect of the arrow, cause the arrowhead to slow down and not fly efficiently, and lack the required effect when the arrow strikes the target or game.

Thus, these items of improved penetration and minimized flight interference must be obtained. These requirements appear to contradict each other. Therefore, it is clearly advantageous to maximize both aspects, in order to have an improved arrowhead on an arrow shaft.

SUMMARY OF THE INVENTION

Among the many objectives of this invention is the provision of an arrowhead with blades, which release as the target is struck.

A further objective of this invention is the provision of an arrowhead having good flight characteristics.

Yet a further objective of this invention is the provision of an arrowhead with minimal deflection as a target is struck.

A still further objective of this invention is the provision of an arrowhead with minimal loss of game.

Also, an objective of this invention is the provision of an arrowhead adapted to fit on a shaft.

Another objective of this invention is the provision of an arrowhead capable minimizing suffering for game.

Yet another objective of this invention is the provision of an arrowhead with additional blades thereon, the additional blades providing minimal flight interference.

Still, another objective of this invention is the provision of an arrowhead for simplified installation on a shaft.

A further objective of this invention is the provision of an arrowhead having improved flight capabilities.

Yet a further objective of this invention is the provision of an arrowhead having improved penetration capabilities.

These and other objectives of the invention (which other objectives become clear by consideration of the specification, claims and drawings as a whole) are met by providing an arrowhead with spring loaded blades restrained thereon, which blades release and penetrate a target as the target is struck by the arrow.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

The arrowhead of this invention has blades that are spring loaded in a downward fashion. As the arrowhead strikes the animal, the spring loaded blades are released and are permitted to cut into the animal in an efficient fashion. With this efficient attack on the animal, the penetration of the arrow and arrowhead greatly improves.

The small blades or sharp edges on the tip of the arrowhead will precut the hole and allow the bigger, spring loaded blades to penetrate the animal. The small blades will go back on the impact of the cutting of the retaining ring and release the big blades. With the structure of the blades, upon release as the arrow strikes an animal, the blades will come out or deploy.

The broadhead or arrowhead of this invention can have auxiliary blades in any number. Preferably the blades are in even numbers. Up to 12 blades are useful. Preferably, the number of blades is two blades, three blades, four blades or six blades. Also, the blades can be set at different angles. Precut grooves in the broadhead style from the arrowhead of this invention will allow the blades thereon to cooperate with the arrow tip and provide a real broadhead system for the arrowhead. The broadhead will lose very little energy on impact with this matter which overcomes the problem with other mechanical broadheads losing a lot of energy due to the folding back of the arrows.

The broadhead will have an easy installation of a new blade assembly. A new insert just needs to be added to the broadhead and the top or arrow needs to be screwed on. The stainless steel spring inside the cylindrical housing for the arrowhead will permit the blades to flare outwardly and to cut into the animal.

The shape and design of the arrowhead permits the arrow to fly truly, because that shape does not adversely affect the design or streamline qualities of the arrow. This arrowhead can fit onto any type of shaft.

Furthermore, this arrowhead is suitable and will be effective against for any type of game, especially big game animals. The grooves on the outside surface of the cylinder for the arrowhead will help the flight help the flight of the arrow. The arrowhead will have better penetration.

More particularly, the small blades or sharpened edges, on the tip of the arrowhead, will hit the target and force the big blades on impact to fully open or deploy. The blades deploy because the retaining ring releases the blades as the arrowhead strikes the target. As the retaining ring releases the blades, the spring forces the blade deployment.

The grooves along the side of the cylinder permit the sliding down of blades and permit the insertion motion to penetrate the animal and achieve the desired results. As the blades expand, more cutting occurs and the effectiveness is achieved.

Figure 1:
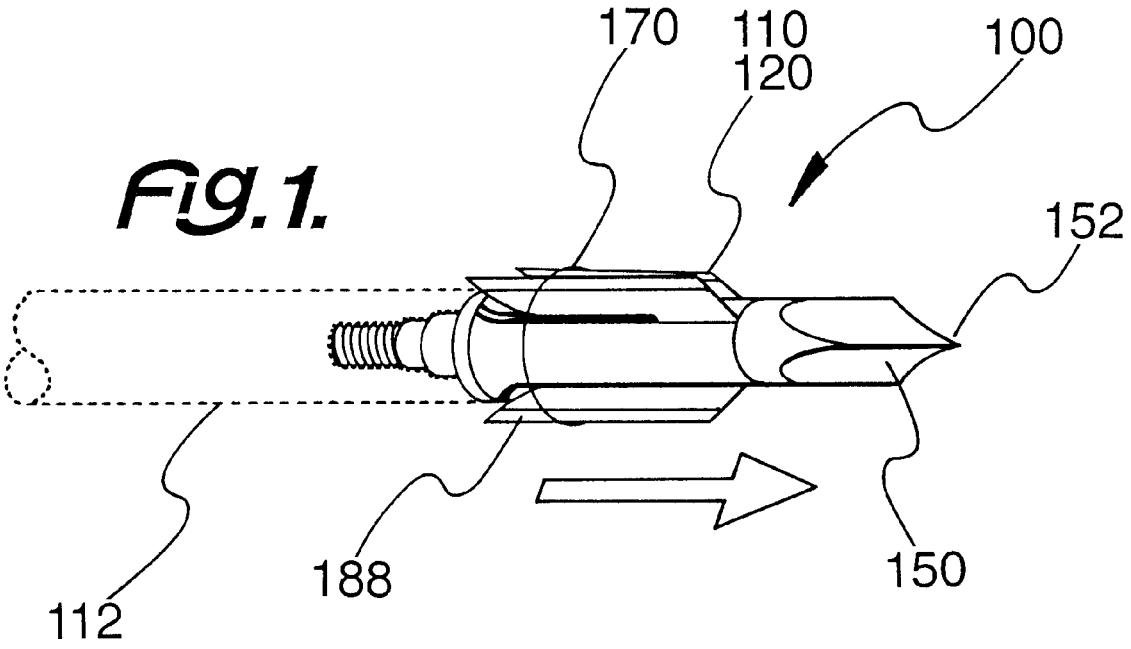
FIG. 1 depicts a perspective view of the arrowhead 100 of this invention, with auxiliary blades 110 in collapsed position 120.

Referring now to FIG. 1, the arrowhead 100 of this invention includes an arrow point 150, having a sharpened tip 152 at one end thereof and a set of female coupling threads 154 at the opposing end thereof. The arrowhead 100 also includes a body cylinder 160. The body cylinder 160 includes at least one traveling slot 162 on the outer portion 164 of body cylinder 160. Preferably there is one traveling slot 162 on the outer portion 164 of body cylinder 160 for each blade 188.

Figure 2:
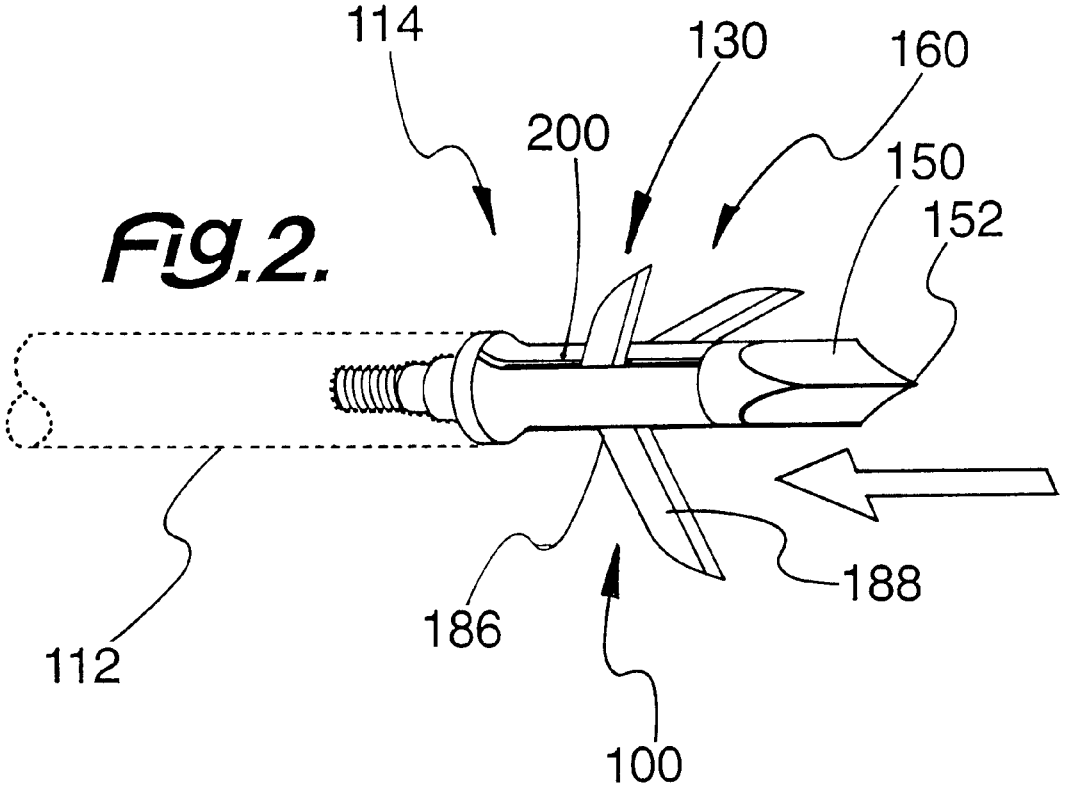
FIG. 2 depicts a perspective view of the arrowhead 100 of this invention, with auxiliary blades 110 in deployed position 130.
Figure 3:
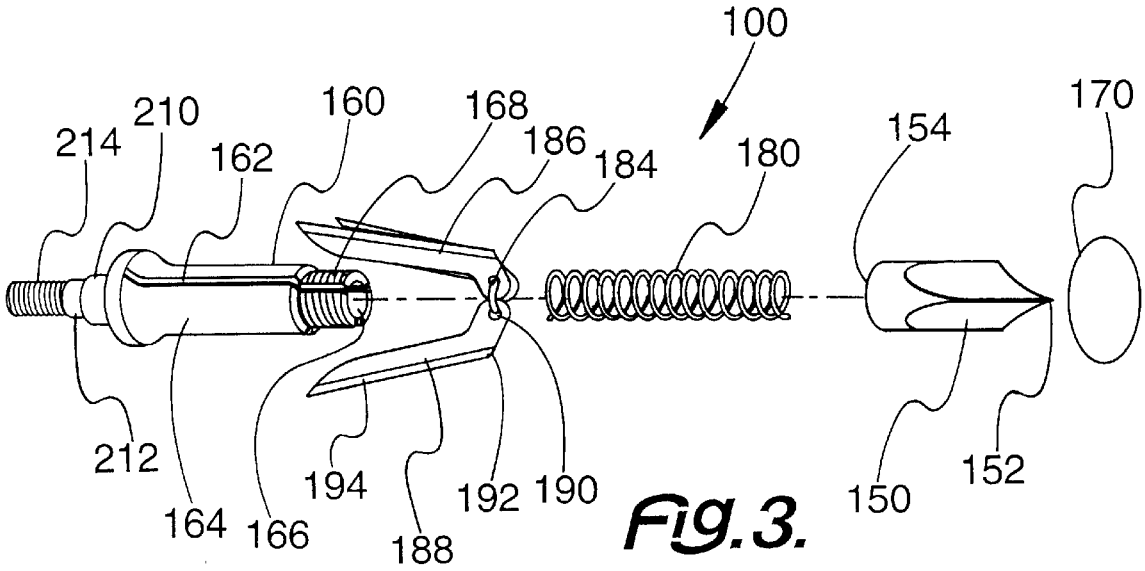
FIG. 3 depicts a perspective, exploded view of the arrowhead 100 of this invention.

Adding FIG. 2 and FIG. 3 to the consideration, the body cylinder 160 also includes a hollow portion 166 with slotted male coupling threads 168 at one end. Into the hollow cylindrical portion 166 fits a spring 180.

Before spring 180 is positioned in hollow cylindrical portion 166, binding ring 184 is placed over coupling threads 168. Blade set 186 is movably, and preferably rotatably mounted, on binding ring 184.

On top of the spring 180 and around male coupling threads 168 is mounted the binding ring 184 containing a blade set 186 with at least one blade 188. Each blade 188 has a blade aperture 190 adapted to fit on the binding ring 184. The spring 180 fits into the hollow cylindrical portion 166. The blade set 186 slides thereover, and the sharpened tip 150, screws onto body cylinder 160 at female coupling threads 154. Preferably sharpened tip 150 has a chisel point 152.

Blade set 186 combines with sharpened tip 150 to achieve the effect of an arrowhead known as a broadhead, on target impact, while having a streamlined structure for flight purposes. In this fashion, arrowhead 100 attaches to arrow shaft 112, in order to provide a more efficient arrow assembly.

Adjacent to or near blade aperture 190 is a streamline arc 192 tapering down to cutting edge 194 of blade 188. In this fashion, blade set 186 is streamlined and provides minimal interference with the flight of arrow assembly 114.

Oppositely disposed from the travel slot 200 and hollow cylindrical portion 166, on the body 160 is a greater mount shank 210. Adjacent thereto is a lesser mount shank 212, and oppositely disposed from the greater mount shank 210 is the solid mounting threads 214. The solid mounting thread 214 fits into the arrow shaft 112 shown in phantom in FIG. 1 and FIG. 2.

Figure 4:
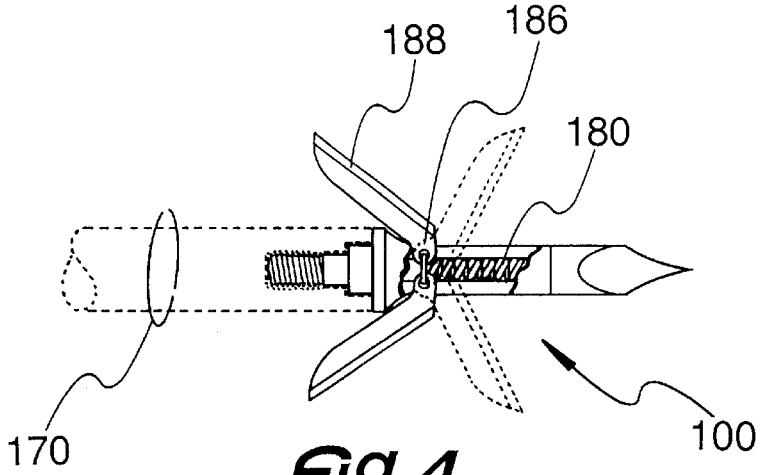
FIG. 4 depicts a side view of the arrowhead 100 of this invention in partial cross section.

With the addition of FIG. 4, releaseable ring 170 holds the blades 188 in an undeployed or a collapsed position 120. As the arrowhead point 150 enters the target 114, the releaseable ring 170 is cut, slips or otherwise releases and the blades 188 of blade set 186. Preferably releaseable ring 170 is a slip ring of a rubberlike material or other elastomer. The ring 170 is made of any material, which will break when desired.

As releaseable ring 170 is removed from blade set 186, blades 188 are forced outwardly by the spring 180 causing the injury and making arrowhead 100 more efficient, and as efficient as a broadhead, with minimal flight interference.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. An arrowhead suitable for hunting big game comprising:

(a) a housing and an arrow point;

(b) the housing being connected to the arrow point;

(c) a blade assembly being mounted as a part of the arrowhead between the housing and the arrow point;

(d) a spring being mounted as a part of the arrowhead between the blade assembly and the arrow point;

(e) the housing having a cylindrical portion;

(f) the cylindrical portion receiving the spring;

(g) a releaseable restraining means supporting the blade assembly;

(h) the releaseable restraining means holding the blade assembly adjacent to the cylindrical portion;

(i) the cylindrical portion having at least one slot to receive at least one blade from the blade assembly;

(j) the at least one blade from the blade assembly being adapted to be restrained from opening due to the spring by the releaseable restraining means;

(k) the blade assembly being spring loaded in a downward fashion;

(l) the releaseable restraining means being a rubberlike or elastomeric ring; and (m) the spring being adapted to force the blade assembly away from the housing.

2. The arrowhead of claim 1 further comprising:

(a) the blade set including a blade ring with a plurality of blades movably mounted thereon;

(b) the blade set being releaseable as the arrowhead strikes a target; and (c) the retaining ring being cuttable by the plurality of blades.

3. The arrowhead of claim 2 further comprising:

(a) the blade set including an even number of blades up to 10 blades;

(b) the spring being adapted to force the blades to cut the retaining ring at an impact of the arrowhead; and (c) the cylindrical portion having a groove for each blade with the blade set in a collapsed position.

4. The arrowhead of claim 3 further comprising:

(a) the arrow point having a sharpened tip at one end thereof and a set of female coupling threads at an opposing end thereof;

(b) the female coupling threads joining the cylindrical portion in female to male relationship;

(c) the cylindrical portion having a set of male cylinder threads to join the female coupling threads and an oppositely disposed set of cylinder female threads; and (d) the cylinder female threads being adapted to join an arrow shaft.

5. The arrowhead of claim 4 further comprising:

(a) the blade assembly including a binding ring;

(b) the binding ring supporting blade set on the cylindrical portion;

(c) each blade having a blade aperture adapted to receive the binding ring; and (d) each blade being movable on the binding ring.

6. The arrowhead of claim 5 further comprising:

(a) the spring fitting into the hollow cylindrical portion;

(b) the blade set sliding over the male cylinder threads;

(c) the blade having a streamlined arc adjacent to the aperture; and (d) the blade tapering from the streamlined arc to a cutting edge for the blade.

7. The arrowhead of claim 6 further comprising:

(a) the cylindrical portion having a travel slot adjacent to the hollow cylindrical portion;

(b) a greater mount shank being oppositely disposed from the travel slot;

(c) a lesser mount shank being adjacent to the greater mount shank; and (d) the solid cylinder male threads being at the lesser mount shank.

8. An arrowhead comprising:

(a) a housing and an arrow point;

(b) the housing being connected to the arrow point;

(c) a blade assembly being mounted as a part of the arrowhead between the housing and the arrow point;

(d) a spring being mounted as a part of the arrowhead between the blade assembly and the arrow point;

(e) the blade assembly giving the arrowhead the effect of broadhead;

(f) the housing having a cylindrical portion;

(g) the cylindrical portion receiving the spring;

(h) a releaseable restraining means supporting the blade assembly;

(i) the releaseable restraining means holding the blade assembly adjacent to the cylindrical portion;

(j) the cylindrical portion having at least one slot to receive at least one blade from the blade assembly;

(k) the at least one blade from the blade assembly being adapted to be restrained from opening due to the spring by the releaseable restraining means;

(l) the blade assembly being spring loaded in a downward fashion;

(m) the releaseable restraining means being a rubberlike or elastomeric ring; and (n) the spring being adapted to force the blade assembly away from the housing.

9. The arrowhead of claim 8 further comprising:

(a) the blade set including a blade ring with a plurality of blades movably mounted thereon;

(b) the blade set being releaseable as the arrowhead strikes a target; and (c) the retaining ring being cuttable by the plurality of blades.

10. The arrowhead of claim 8 further comprising:

(a) the blade set including an even number of blades up to 8 blades;

(b) the spring being adapted to force the blades to cut the retaining at an impact of the arrowhead; and (c) the cylindrical portion having a groove for each blade with the blade set in a collapsed position.

11. The arrowhead of claim 10 further comprising:

(a) the arrow point having a sharpened tip at one end thereof and a set of female coupling threads at an opposing end thereof;

(b) the female coupling threads joining the cylindrical portion in female to male relationship;

(c) the cylindrical portion having a set of male cylinder threads to join the female coupling threads and an oppositely disposed set of cylinder female threads; and (d) the cylinder female threads being adapted to join an arrow shaft.

12. The arrowhead of claim 11 further comprising:

(a) the blade assembly including a binding ring;

(b) the binding ring supporting blade set on the cylindrical portion;

(c) each blade having a blade aperture adapted to receive the binding ring;

(d) each blade being movable on the binding ring;

(e) the spring fitting into the hollow cylindrical portion;

(f) the blade set sliding over the male cylinder threads;

(g) the blade having a streamlined arc adjacent to the aperture; and (h) the blade tapering from the streamlined arc to a cutting edge for the blade.

13. The arrowhead of claim 12 further comprising:

(a) the cylindrical portion having a travel slot adjacent to the hollow cylindrical portion;

(b) a greater mount shank being oppositely disposed from the travel slot;

(c) a lesser mount shank being adjacent to the greater mount shank; and (d) the solid cylinder male threads being at the lesser mount shank.

14. The arrowhead of claim 10 further comprising the blade set including six blades.

15. The arrowhead of claim 10 further comprising the blade set including four blades.

16. The arrowhead of claim 10 further comprising the blade set including two blades.

* * * * *